United States Patent [19]

Schacht

[11] 3,981,031

[45] Sept. 21, 1976

[54] INCLINED BEDREST

[76] Inventor: Louis L. Schacht, 278-3B Crosse Drive, Cranbury, N.J. 08512

[22] Filed: Aug. 27, 1975

[21] Appl. No.: 608,031

[52] U.S. Cl. ..... 5/327 B; 5/72

[51] Int. Cl.[2] ..... A47C 21/00

[58] Field of Search ..... 5/327 R, 327 B, 317 R, 5/59 R, 71, 72; 297/230, 231, 444, 443, 352, 252

[56] References Cited

UNITED STATES PATENTS

| | | | |
|---|---|---|---|
| 1,936,198 | 11/1933 | Kirsch | 160/349 R |
| 2,663,880 | 12/1953 | Meeks | 5/327 R |
| 2,766,463 | 10/1956 | Bendersky | 5/327 R |
| 2,807,308 | 9/1957 | Hamilton | 297/441 R |
| 3,287,746 | 11/1966 | Weddle | 5/327 R |
| 3,790,973 | 2/1974 | Bradley | 5/327 B |
| 3,884,225 | 5/1975 | Witter | 5/327 R |
| 3,895,840 | 7/1975 | Szurszewski | 5/327 R |

FOREIGN PATENTS OR APPLICATIONS

| | | | |
|---|---|---|---|
| 558,682 | 10/1923 | France | 5/327 |

*Primary Examiner*—Casmir A. Nunberg
*Attorney, Agent, or Firm*—Natter & Natter

[57] ABSTRACT

An improved portable inclined bedrest is secured to a bed by the weight of the mattress. A tubular steel frame is vertically extendible from within a storage housing and can be locked in position at selected heights above the mattress by the rotatable movement of a pair of swing arms mounted on the frame. A slant sheet for propping a pillow is affixed along an upper edge to the frame. The lower edge of the slant sheet is releasably fastened to the swing arms. The return movement of the swing arms to the initial position releases the frame for retraction into the storage housing.

10 Claims, 6 Drawing Figures

FIG. 4
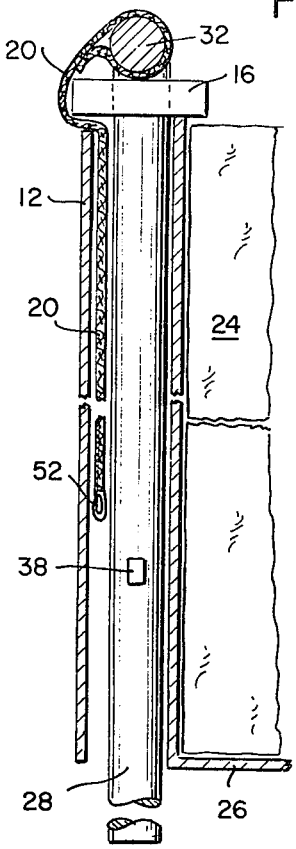
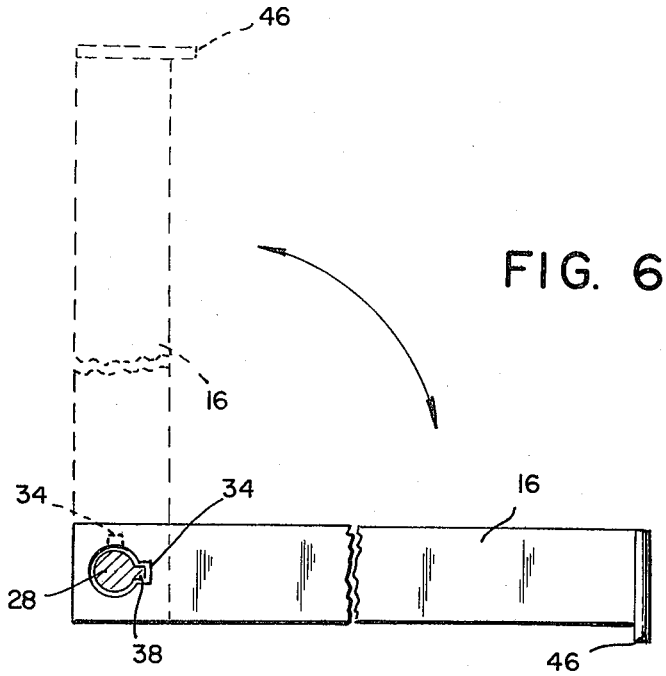
FIG. 6
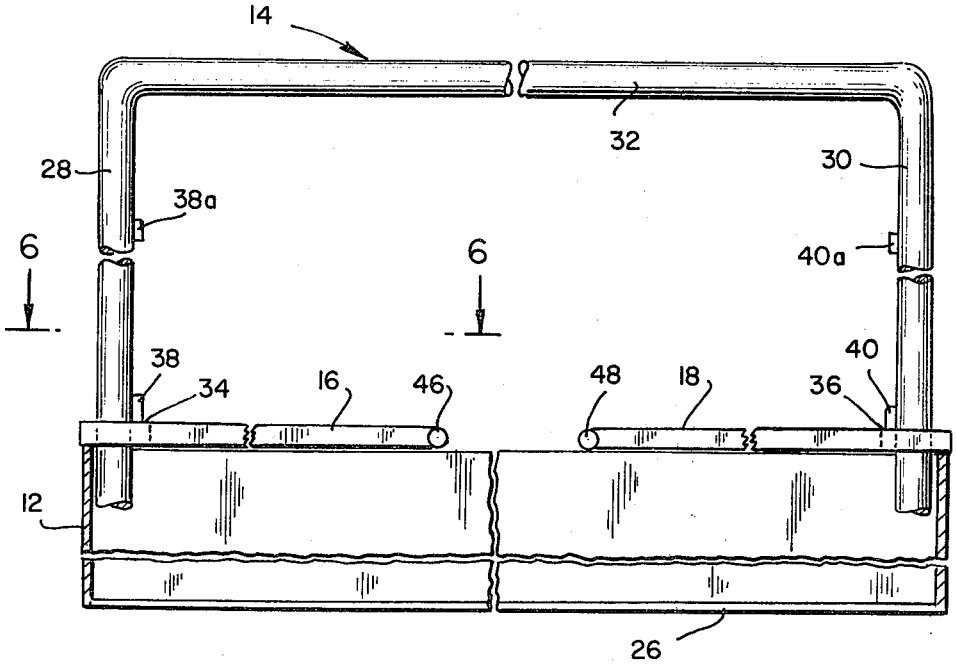
FIG. 5

INCLINED BEDREST

BACKGROUND OF THE INVENTION

1. Field of the Invention

This invention relates to bed attachments and accessories and especially to an inclined bedrest.

In particular, the device of this invention concerns an extendible support mechanism securable to a bed for holding a pillow in an inclined position on a bed. The support structure of this invention can be retracted for concealment when not in use.

2. Description of the Prior Art

Many devices have been described for supporting a person while in bed. In general, the prior art disclosed both portable headrests and mechanical bed attachments wherein a tiltable panel is incorporated into a headboard. In the latter devices the headboard is formed as an integral part of the bedstead or is otherwise permanently fastened to the bed frame. These known bed attachments, such as shown in U.S. Pat. Nos. 3,287,746 and 3,482,271, require custom installation and are intended to remain permanently affixed to the bed. Furthermore, such headboard attachments are rather expensive in comparison to the portable bedrest of this invention. A further disadvantage of these tiltable headboards is that they frequently are aesthetically unpleasing and further may not always be in harmony with the other room furniture or decor.

The present invention, in contrast, does not require any special installation, is portable and can be removed from the bed or affixed to the bed without any tools or particular mechanical dexterity. Furthermore, the bedrest of this invention is retractable and can be hidden from view behind the head of the bed when not being used.

Other portable bed accessories for providing a head or back rest include the portable prop structures that are not attached to the bed but rather are positioned in place on the mattress or against the headboard in order to support a person. Typical of such devices are cushion bed rests and polyurethane foam wedges. Another such portable device having a collapsible frame structure is shown in U.S. Pat. No. 2,663,880. An attachable frame rest is also described in U.S. Pat. No. 1,156,125.

A problem with these kinds of back rests is that it is necessary to remove them when the person desires to go to sleep in a prone position. The additional movement required to reposition the pillows frequently disturbs the person's disposition to fall asleep and can reawaken the person. Also these devices must be separately stored when the bed is to be made. Furthermore, the aforementioned devices are really no more convenient than propping a plurality of pillows against a headboard to provide a back rest. This is obviously a distinct disadvantage and shortcoming of these portable bed rests and is overcome by the instant invention.

Another feature of this invention is that the inclined bedrest is designed with a slant sheet which is readily releasable by movement of the swing arms, as when one wishes to go to sleep. Once the slant sheet is released, the pillows will fall back and lie flat on the mattress. The frame will remain in its extended position and can be retracted in the morning.

BRIEF SUMMARY OF THE INVENTION

The nature of this invention concerns an improved portable inclined bedrest that is removably attachable to a bed.

The bedrest of this invention includes a frame assembly which is vertically extendible from within a storage housing. The housing has an integral projecting platform which is adapted to be inserted under the mattress to thereby clampingly secure the housing to the bed by the deadload weight of the overlying mattress and the body or live weight of the person on the mattress. When the frame assembly is retracted within the storage housing, it is substantially concealed from view. The frame can be slidably lifted out of the housing and locked at a selected vertical height for providing support at different incline angles by the cooperative movement of a pair of horizontal swing arms which are contiguous to the upper surface of the mattress and secured to the frame assembly. A slant sheet of flexible material or fabric is fastened along an upper edge to the frame assembly. The swing arms have retainer pins which engage the lower edge of the slant sheet such that a pillow can be supported against the slant sheet. The retainer pins can be released as desired by movement of the swing arms without affecting the frame assembly. Further displacement of the swing arms toward the housing is effective to release the frame for retraction into the housing.

It is a purpose of this invention to provide an improved inclined bedrest for supporting a person in an inclined position to facilitate reading, eating, watching television, etc., while in bed. The device can also be used to comfortably raise the head, shoulders and back of a sick, convalescent, or invalid patient. A feature of this invention is that the slant sheet can be released and the pillows lowered to the mattress without the need for getting out of bed or retracting the frame assembly. Another advantage is that the frame assembly and slant sheet are concealed when the bed is made.

Having thus summarized the invention, it will be seen that an object thereof is to provide an improved inclined bedrest of the general character described herein.

Specifically, it is an object of this invention to provide a portable bedrest which can be easily attached to a bed and held in place by the overlying weight of a mattress.

A further object of this invention is to provide an inclined bedrest which can be concealed from view when the bed is made.

Another object of this invention is to provide an inclined bedrest having a slidable frame assembly which can be raised to selective vertical heights above the mattress and held there by the cooperative interaction of a pair of rotatable swing arms, thus providing support at different incline angles.

Still another object of this invention is to provide an inclined bedrest having a slant sheet for supporting a pillow wherein the slant sheet can be released and the pillow allowed to lie flat without lowering the frame assembly.

Yet another object of this invention is to provide an inclined bedrest wherein the frame assembly and the slant sheet can be retracted into the storage housing.

The above and other objects, features and advantages of this invention will be apparent in the following description of the preferred embodiment when considered in connection with the accompanying drawings.

BRIEF DESCRIPTION OF THE DRAWINGS

In the accompanying drawings in which is shown the preferred embodiment of this invention.

FIG. 4 is a partial sectional view which shows the frame assembly and slant sheet when stored within the housing;

FIG. 5 is a partial front elevational view of the frame assembly and swing arms; and FIG. 6 is a plan view taken substantially along line 6—6 of FIG. 5 and illustrates the movement (as indicated by the arrows) of the swing arm which is rotatably mounted to the frame assembly; it further shows a keyway in the swing arm and a corresponding locking lug on the frame assembly; the broken line position of the swing arm provides an abutment surface for the locking lug to thereby prevent vertical movement of the frame assembly.

DETAILED DESCRIPTION OF THE INVENTION

Figure 1:
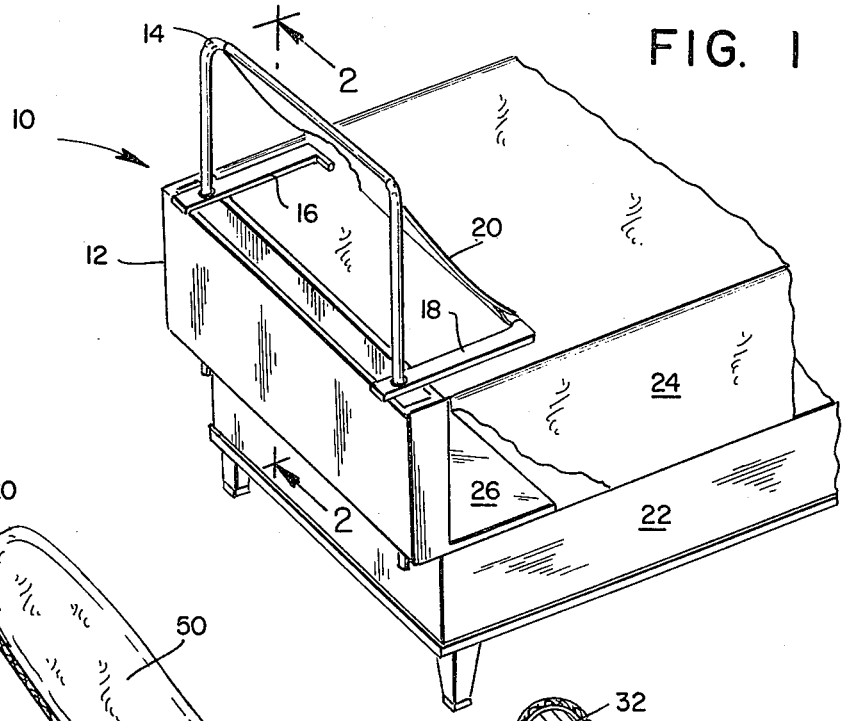
FIG. 1 is a perspective view of an inclined bedrest of this invention and shows the invention attached to a bed by the weight of an overlying mattress.

Referring now in detail to the drawings, the reference numeral 10 refers generally to an improved portable inclined bedrest of this invention. The bedrest device 10 is comprised of a substantially rectangular storage housing 12, a frame assembly 14, a pair of swing arms 16, 18 and a slant sheet 20.

The bedrest 10 is suitable for use with a conventional bedstead 22 including a mattress 24. The device 10 is adapted for attachment to the bedstead 22 for providing an anatomical support especially for the head, back and shoulders.

The storage housing 12 in a preferred embodiment includes a generally rectangular enclosure having four parallel side walls approximating in height the thickness of the mattress 24 and being open at the top and bottom. The storage housing 12 is provided with a horizontal platform or anchoring plate 26 formed integrally with or otherwise structurally incorporated into a side wall and being coextensive with the wall and extending a distance substantially equal to the width of the bedstead 22. The anchoring plate 26 is adapted for insertion under the mattress 24 and the housing 12 is held to the bedstead 22 by the overlying dead weight of the mattress 24. Although additional forces are exerted on the slant sheet 20 and frame assembly 14 when the device 10 is being used, the increase in live load of the person lying on the mattress 24 provides an additional compensatory factor of safety. It should also be apparent that the size of the anchoring plate 26 can be increased in accordance with the load requirements so that it can extend under a greater portion of the mattress 24.

Figure 2:
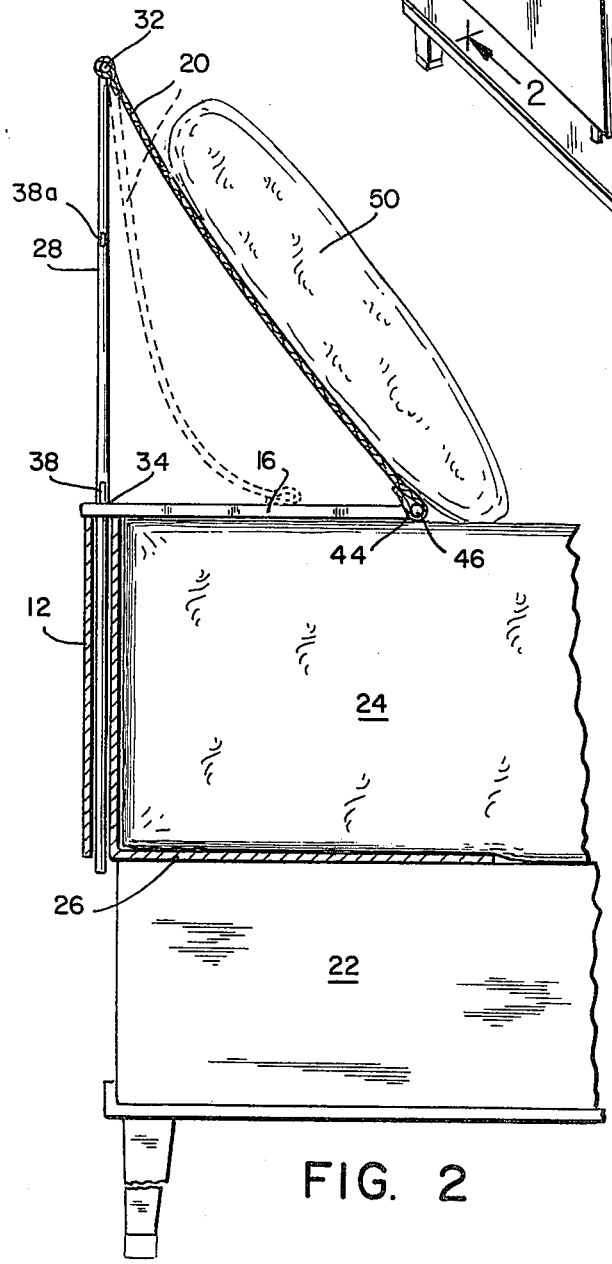
FIG. 2 is a sectional view to a slightly enlarged scale taken along line 2—2 of FIG. 1 and shows an extended frame assembly and a slant sheet engaged by a swing arm for supporting a pillow; the broken line position illustrates a slant sheet disengaged from the swing arm.

Referring now to the frame assembly 14 as shown in FIGS. 2 and 5, a pair of parallel vertical bars 28, 30 are connected at their upper ends by a horizontal cross bar 32. This assembly 14 can for instance be fabricated from tubular steel, aluminum or other stock material which provides the requisite strength and rigidity. The vertical bars 28, 30 are designed to be withdrawn from the housing 12 as by grasping the cross bar 32 and manually pulling upward. The frame assembly 14 can thus be lifted to an extended operational position as noted in FIGS. 1 and 2. Conversely, the vertical bars 28, 30 can be slidingly lowered or retracted into the housing 12 for storage and will assume a position as indicated in FIG. 4. In order to assure correct alignment during such displacement of the frame assembly 14, sleeve guides (not shown) for receiving the bars 28, 30 can be incorporated into the housing 12.

With regard to securing the frame assembly 14 in the extended operational mode, attention will now be directed to the swing arms 16, 18. The arms 16, 18 are rotatably mounted around the respective vertical bars 28, 30. The swing arms 16, 18 are provided with a keyway 34, 36 respectively having circular apertures with a diameter slightly greater than the diameter of the bars 28, 30 to permit slidable movement therethrough.

Figure 3:
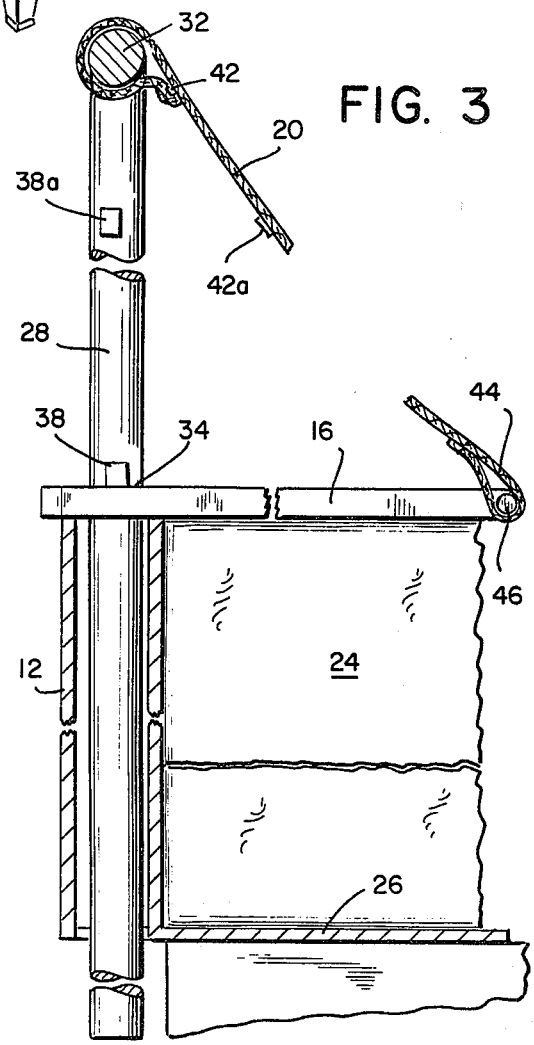
FIG. 3 is a detailed sectional view of the frame assembly in its extended position with the swing arm deployed for cooperative interaction with a locking lug for maintaining the frame assembly at selected heights.

The vertical bars 28, 30 have a locking lug 38, 40, respectively, being in registered alignment with the respective keyways 34, 36 when the swing arms 16, 18 are positioned overlying the top of housing 12 as shown in FIGS. 5 and 6. It should be apparent that as the frame assembly is pulled out of the housing 12, the locking lugs 38, 40 slide through the complementary keyways 34, 36 (see FIG. 6). The swing arms 16, 18 are then moved outwardly over the mattress 24 to assume a position as shown in FIGS. 2 and 3. The locking lugs 38, 40 will now rest on the swing arms 16, 18 which provide a stop since the keyway is no longer aligned (note broken line illustration in FIG. 6).

In order to provide selective height adjustment a secondary locking lug **38*a*, 40*a* can be provided for similar cooperative interaction with the swing arms 16, 18. In this manner the frame assembly 14 can be raised and locked at desired elevations corresponding to different incline angles or orientations of the slant sheet 20**.

The slant sheet 20 which can be fabricated of canvas, muslin fabric or other strong, durable cloth material is secured along an upper edge to the cross bar 32 by a releasable fastening device, such as a plurality of snap fasteners 42. The other lower edge of the sheet 20 can be folded back and sewn so as to form a loop or pocket 44 open at both ends. Alternatively, an eyelet or grommet could be incorporated. Each of the swing arms 16, 18 is provided with a retainer pin 46, 48 for engagement within the pocket 44 to hold the sheet 20 firmly in place. When it is desired to release the slant sheet 20, the arms 16, 18 are displaced outwardly toward the respective opposite edges of the mattress 24. This will withdraw the retainer pins 46, 48 and the sheet 20 will hang freely from the cross bar 32. Accordingly, it should be apparent that if a pillow 50 was propped against the slant sheet 20 and a person resting against the pillow 50 while reading desired to release the sheet 20, as when going to sleep, this could be accomplished in a relatively simple manner and without getting out of bed or other inconveniences (note released slant sheet in FIG. 2).

It should further be pointed out that supplementary fastening devices such as a mating snap **42*a* compatible for use with the female element of snap 42 can be included and the sheet 20 can be thus tightened to take up the slack, especially when the frame assembly 14 is raised to a lowermost position corresponding to locking lugs 38*a*, 40*a***.

In connection with the retraction of the frame assembly 14 and concealed storage within housing 12, it should be noted that after releasing the lower edge of the sheet 20, the swing arms 16, 18 can be moved toward the initial position shown in FIGS. 5 and 6, the locking lugs 38, 40 will now be in registered alignment and to slide through the keyways 34, 36 respectively.

By holding the cross bar 32, the frame assembly 14 can be lowered into the housing 12. The slant sheet 20 should be first inserted, however, and this can be done by raising the swing arm 16, 18 slightly. In order to facilitate the lowering of the sheet 20 a weight 52 is sewn into the lower edge so that it will hang vertically within the housing 12.

As other possible embodiments might be made of the present invention and as various changes might be made in the embodiment as set forth, it is to be understood that all matter herein described or shown in the accompanying drawings is to be interpreted as illustrative and not in the limiting sense.

Having thus described the invention, there is claimed as new and desired to be secured by Letters Patent:

1. A portable bed attachment for providing anatomical support comprising a frame assembly, attachment means for mounting the frame assembly along a marginal edge of a bed, swing arms rotatably mounted to the frame assembly, locking means integral with the frame assembly and cooperatively interacting with the swing arms for releasably securing the frame assembly in an extended mode projecting vertically above the bed, said locking means being activated by the horizontal deployment of the swing arms, a slant sheet fastened along one edge to the frame assembly, sheet engagement means on said swing arm for grippingly receiving an opposite edge of the sheet when in said deployed position, whereby the sheet defines an inclined pillow supporting surface, said opposite edge of the sheet further being selectively releasable from engagement with the swing arms to remove the pillow support.

2. A portable bed attachment as claimed in claim 1 further including a housing, said housing having a projecting anchoring plate, said plate being adapted for insertion under a bed mattress whereby the weight of the mattress secures the bed attachment.

3. A portable bed attachment as claimed in claim 2 wherein the top of the housing lies substantially in a horizontal plane coincident with the upper surface of the bed mattress with the frame assembly and sheet means being slidably retractable into the housing for concealed storage.

4. A portable bed attachment as claimed in claim 1 wherein the swing arm defines a keyway aperture, and the frame assembly includes a locking lug registrable with the keyway for passage therethrough.

5. A portable bed attachment as claimed in claim 4 wherein the locking lug is adapted for abutment with the swing arm after being raised above the swing arm to a selected vertically extended mode and the swing arm has been deployed.

6. A bed attachment as claimed in claim 5 wherein the locking means includes a plurality of vertically spaced locking lugs for providing variable height adjustment.

7. A bed attachment as claimed in claim 6 wherein the sheet means is adjustably fastenable to the frame assembly and can be tightened to remove slack in accordance with the variable raised height of the frame assembly.

8. A portable bed attachment as claimed in claim 1 wherein the swing arm engagement means includes a retainer pin, said retainer pin being adapted to engage and releasably secure the sheet means to provide a firm slant sheet supporting surface.

9. A bed attachment as claimed in claim 8 wherein the frame assembly includes two parallel substantially vertical bars joined at their upper ends by a substantially horizontal cross bar.

10. A portable bed attachment as claimed in claim 9 wherein the sheet means is weighted to facilitate retraction into the housing for storage.

* * * * *